US010013927B2

(12) United States Patent
Zhou et al.

(10) Patent No.: US 10,013,927 B2
(45) Date of Patent: Jul. 3, 2018

(54) DISPLAY DRIVER HAVING SOURCE ELECTRODE DRIVER RECEIVING IMAGE DATA DIRECTLY FROM DATA STORAGE, AND DISPLAY AND TERMINAL USING THE SAME

(71) Applicant: Wuhan China Star Optoelectronics Technology Co., Ltd., Wuhan, Hubei (CN)

(72) Inventors: Jinjie Zhou, Guangdong (CN); Hongrui Cao, Guangdong (CN); Jiehui Qin, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 105 days.

(21) Appl. No.: 15/114,330

(22) PCT Filed: Jun. 27, 2016

(86) PCT No.: PCT/CN2016/087255

§ 371 (c)(1),
(2) Date: Jul. 26, 2016

(87) PCT Pub. No.: WO2017/197724

PCT Pub. Date: Nov. 23, 2017

(65) Prior Publication Data

US 2017/0337883 A1 Nov. 23, 2017

(30) Foreign Application Priority Data

May 20, 2016 (CN) ..... 2016 1 0339364

(51) Int. Cl.
*G09G 3/36* (2006.01)
*G09G 3/34* (2006.01)

(52) U.S. Cl.
CPC ..... *G09G 3/3413* (2013.01); *G09G 3/3607* (2013.01); *G09G 2310/08* (2013.01); *G09G 2320/064* (2013.01)

(58) Field of Classification Search
CPC ..... G09G 3/18; G09G 3/2003; G09G 2310/0264–2310/0297; G09G 2320/00–2320/106
See application file for complete search history.

(56) References Cited

U.S. PATENT DOCUMENTS

2008/0266236 A1* 10/2008 Shen ..... G09G 3/3406 345/102
2010/0164998 A1 7/2010 Li et al.
(Continued)

FOREIGN PATENT DOCUMENTS

CN 1423234 A 6/2003
CN 1564240 A 1/2005
(Continued)

*Primary Examiner* — Sanghyuk Park
(74) *Attorney, Agent, or Firm* — Andrew C. Cheng

(57) ABSTRACT

The disclosure provides a display driver, applied to process image data sent by a processor, the driver includes a time sequence controller, a data receiver connected with the time sequence controller electrically, an image processing module, a data storage module, a pulse width modulation register and a source electrode driver; when the display processor sends static image data, the static image data received by the data receiver is processed by the image processing module, the pulse width modulation register stores a backlight adjustment signal generated by the image processing module first processing the static image data, the static image data processed by the image processing module is stored in the data storage module, the time sequence controller controls the source electrode driver to read the static image data stored in the data storage module, simultaneously reading
(Continued)

the backlight adjustment signal stored in the pulse width modulation register to adjust backlight.

16 Claims, 1 Drawing Sheet

(56) References Cited

U.S. PATENT DOCUMENTS

| | | | | |
|---|---|---|---|---|
| 2011/0175874 | A1 | 7/2011 | Wakimoto et al. | |
| 2014/0198123 | A1* | 7/2014 | Shibamiya | G09G 3/36 345/589 |
| 2015/0364094 | A1* | 12/2015 | Takasaki | G09G 3/342 345/593 |

FOREIGN PATENT DOCUMENTS

| | | | |
|---|---|---|---|
| CN | 101739973 | A | 6/2010 |
| CN | 103377609 | A | 10/2013 |
| CN | 103460279 | A | 12/2013 |
| CN | 103971647 | A | 8/2014 |
| JP | 2016085348 | A | 5/2016 |

* cited by examiner

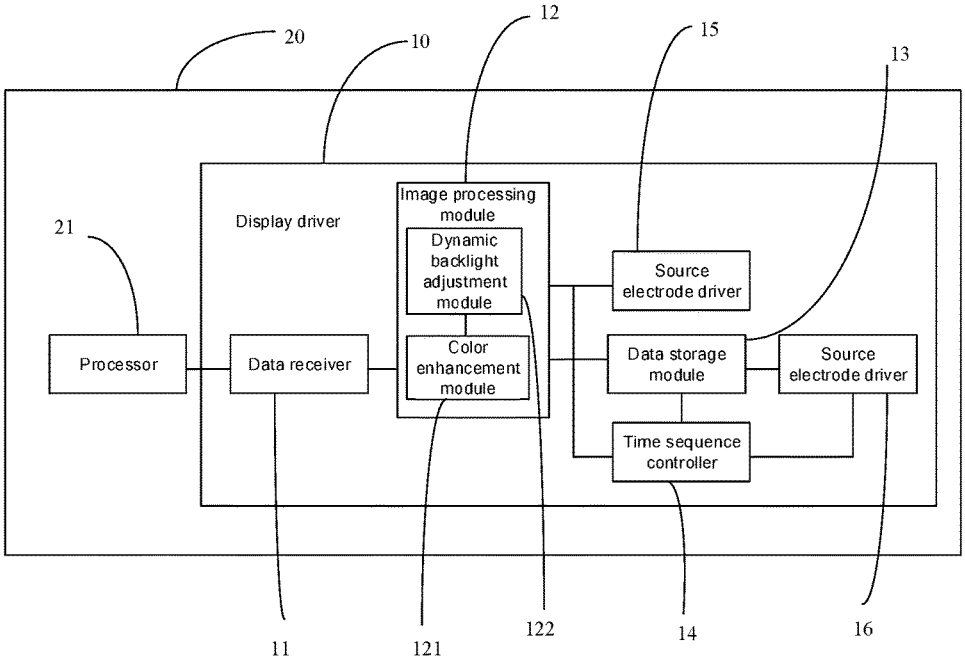
20
10
12
15
13
21
Display driver
Image processing module
Dynamic backlight adjustment module
Color enhancement module
Source electrode driver
Processor
Data receiver
Data storage module
Source electrode driver
Time sequence controller
11
121
122
14
16

DISPLAY DRIVER HAVING SOURCE ELECTRODE DRIVER RECEIVING IMAGE DATA DIRECTLY FROM DATA STORAGE, AND DISPLAY AND TERMINAL USING THE SAME

CROSS REFERENCE

This disclosure claims priority to Chinese patent application No. 201610339364.1, entitled "Display driver, display and terminal" filed on May 20, 2016, which is incorporated by reference in its entirety.

FIELD OF THE DISCLOSURE

The disclosure relates to a liquid crystal display technical field, and more particularly to a display driver, a display and a terminal.

BACKGROUND OF THE DISCLOSURE

Smart phones have undergone a rapid development in recent years, power consumption is growing with accumulative functions coming out. A display consumes the most energy in a mobile phone. An integrated data storage module embedded in the display driver is a conventional manner for saving energy, when an animated image is displayed, image data will be sent from a data sender of a mobile phone application processor to the display driver, a data receiver in the driver stores the received data in the integrated data memory and displays immediately. When a frozen image is displayed, the application processor stops sending image data, a conventional display driver stores the received image data in the integrated data memory. When a frozen image is displayed, the display driver will read the image date directly, after several image processing modules, such as color enhancement, dynamic backlight control, then sent to the screen by a source electrode driver, in the process, each of the frozen images still need to be processed by for example the color enhancement and the dynamic backlight control modules, both of which consume energy.

SUMMARY OF THE DISCLOSURE

The objective of the disclosure is to provide an energy-efficient driver that reduces energy consumption of a display and the display.

The disclosure further provides a terminal.

A display driver provided by the application is applied to process image data sent by a processor, the driver includes a data receiver, an image processing module, a data storage module, a time sequence controller and a source electrode driver; the time sequence controller controls the data receiver, the image processing module, the data storage module to work.

The date receiver receives the image data sent from the processor and sends to the image processing module, the image processing module processes the image data sent from the processor, the display driver further includes a pulse width modulation register; the data storage module stores the image data processed by the image processing module; the pulse width modulation register stores a backlight adjustment signal generated after the image processing module first frame processing static image data; the time sequence controller controls the source electrode driver to receive and send the image data sent by the data storage module; when the processor sends static image data, the static image data received by the data receiver will be processed by the image processing module, the pulse width modulation register stores a backlight adjustment signal generated by the image processing module first frame processing the static image data, the static image data processed by the image processing module is stored in the data storage module, the time sequence controller controls the static image data stored in the data storage module to send to the source electrode driver, simultaneously outputs the backlight adjustment signal stored in the pulse width modulation register.

When the display processor sends dynamic image data, the dynamic image data received by the data receiver is stored in the data storage module after being processed by the image processing module, the pulse width modulation register stores a dynamic backlight adjustment signal generated by the image processing module processing each of the dynamic image data, the time sequence controller reads the dynamic image data stored in the data storage module and sends to the source electrode driver, simultaneously the time sequence controller reads the dynamic backlight adjustment signal stored in the pulse width modulation register to adjust backlight.

The image processing module includes a color enhancement module and a dynamic backlight adjustment module, the color enhancement module enhances colors of the image data sent by the data receiver, the dynamic backlight adjustment module adjusts a backlight gray scale and brightness of the image data processed by the color enhancement module.

The display of the application includes a display panel and a display driver; the display driver and the display panel are connected electrically to drive a circuit of the display panel; the driver includes a data receiver, an image processing module, a data storage module, a time sequence controller and a source electrode driver; the date receiver receives the image data sent from the processor and sends to the image processing module, the image processing module processes the image data sent by the processor, the display driver further includes a pulse width modulation register; the data storage module stores the image data processed by the image processing module; the pulse width modulation register stores a backlight adjustment signal generated after the image processing module first frame processing static image data; the time sequence controller controls the source electrode driver to receive and send the image data sent by the data storage module; when the processor sends static image data, the static image data received by the data receiver is processed by the image processing module, the pulse width modulation register stores a backlight adjustment signal generated by the image processing module first frame processing the static image data, the static image data processed by the image processing module is stored in the data storage module, the time sequence controller controls the static image data stored in the data storage module to send to the source electrode driver, simultaneously outputs the backlight adjustment signal stored in the pulse width modulation register.

When the display processor sends dynamic image data, the dynamic image data received by the data receiver is stored in the data storage module after being processed by the image processing module, the pulse width modulation register stores a dynamic backlight adjustment signal generated by the image processing module processing each of the dynamic image data, the time sequence controller reads the dynamic image data stored in the data storage module and sends to the source electrode driver, simultaneously the time sequence controller reads the dynamic backlight adjustment signal stored in the pulse width modulation register to adjust backlight.

The image processing module includes a color enhancement module and a dynamic backlight adjustment module, the color enhancement module enhances colors of the image data sent by the data receiver, the dynamic backlight adjustment module adjusts a backlight gray scale and brightness of the image data processed by the color enhancement module.

The display is a liquid crystal display.

The display further includes a thin film transistor switch device, the source electrode driver is applied to connect a source electrode of the thin film transistor switch device.

A mobile terminal of the application includes the display in the claims and a mainboard, the mainboard has an application processor, the application processor is connected to the circuit board for sending the image data to the circuit board.

The image processing module is disposed in back of the data storage module according to the display driver described in the disclosure, the image processing module only needs to process the first frame of the image data during processing static image data, then the image data is stored in the data storage module, the pulse width modulation register stores a backlight adjustment signal generated by the image processing module first frame static image data, it is unnecessary to re-utilize the image processing module during reading the image data in the data storage module, which saves energy.

BRIEF DESCRIPTION OF THE DRAWINGS

In order to more clearly illustrate the disclosure, following FIGURES described in embodiments will be briefly introduced, it is obvious that the drawings are merely some embodiments of the disclosure, a person skilled in the art can obtain other FIGURES according to these FIGURES without creativity.

FIG. 1 is a schematic view of a functional module of a terminal provided by the disclosure.

DETAILED DESCRIPTION OF PREFERRED EMBODIMENTS

Embodiments of the disclosure are described in detail with reference to the accompanying drawings as follows, obviously, the described embodiments are part of embodiments of the disclosure rather than all of them. Based on the embodiments of the disclosure, all other embodiments obtained by a person skilled in the art without creativity should be considered within the scope of protection of the disclosure.

Referring to FIG. 1, the disclosure provides a display driver 10, a display and a terminal 20, the display driver is applied to process image data sent by the processor 21 and send to the display for driving the display. The display includes a display panel connected with the display driver electrically, the display is a liquid crystal display. The terminal can be a mobile phone or a display, a mobile phone is taken as an example in the embodiment. The terminal 20 includes a mainboard, the mainboard has the processor 21, and the processor 21 is connected to the display driver 10 for driving the display driver.

In the embodiment, the display driver 10 includes a data receiver 11, an image processing module 12, a data storage module 13, a time sequence controller 14 and a source electrode driver 15.

The date receiver 11 receives the image data sent from the processor 21 and sends to the image processing module 12. The image processing module 12 processes the image data sent from the data receiver 11. In the embodiment, the image processing module 12 includes a color enhancement module 121 and a dynamic backlight adjustment module 122, the color enhancement module 121 enhances colors of the image data sent by the data receiver, the dynamic backlight adjustment module 122 adjusts a backlight gray scale and brightness of the image data processed by the color enhancement module. A white balance adjustment module, an image data sharpness enhancement module can likewise be included, which are not shown the FIGURE.

The data storage module 13 stores the image data processed by the image processor 12; the display driver 10 further includes a pulse width modulation register 16. The pulse width modulation register 16 stores a backlight adjustment signal generated after the image processing module 12 processing the image data.

The time sequence controller 14 controls the source electrode driver 15 to receive and send the image data sent by the data storage module 13. In the embodiment, the display further includes a thin film transistor switch device, the source electrode driver is connected to a source electrode of the thin film transistor switch device, so that the driver can drive the display.

Referring to FIG. 1, when the processor 21 sends static image data, the static image data received by the data receiver 11 is processed by the image processing module 12, the pulse width modulation register 16 stores a backlight adjustment signal generated by the image processing module 12 first frame processing the static image data, the static image data processed by the image processing module 12 is stored in the data storage module 13, the time sequence controller 14 controls the static image data stored in the data storage module 13 to be sent to the source electrode driver 15, simultaneously outputting the backlight adjustment signal stored in the pulse width modulation register 16.

As the image processing module 12 is disposed behind the data storage module 13, data stored in the data storage module 13 has been processed by the image processing module 12, the time sequence controller 14 reads from the data storage module 13 directly, compared with a conventional manner that the image processing module needs to be recalled each time, the image data read from the data storage module 13 has been processed in the disclosure, which is unnecessary to be processed by the image processing module 12, preventing energy consumption by the image processing module 12 and reducing consumption of the terminal.

When the processor 21 sends dynamic image data, the dynamic image data received by the data receiver 11 is stored in the data storage module 13 after being processed by the image processing module 12, the pulse width modulation register 16 stores a dynamic backlight adjustment signal generated by the image processing module 12 processing each of the dynamic image data, the time sequence controller 14 controls the source electrode driver 15 to read the dynamic image data stored in the data storage module 13, simultaneously reading the dynamic backlight adjustment signal stored in the pulse width modulation register 16 to adjust backlight.

Above are embodiments of the disclosure, which do not limit the scope of the disclosure, any modifications, equivalent replacements or improvements within the spirit and principles of the embodiments described above should be covered by the protected scope of the disclosure.

What is claimed is:

1. A display driver, applied to process image data sent from a processor, the driver comprising a data receiver, an image processing module, a data storage module, a time sequence controller and a source electrode driver;

the data receiver receiving the image data sent from the processor and sending to the image processing module, the image processing module processing the image data sent from the processor, wherein the display driver further comprises a pulse width modulation register;

the data storage module storing the image data processed by the image processing module;

the pulse width modulation register storing a backlight adjustment signal generated after the image processing module processing the image data;

the time sequence controller controlling the source electrode driver to receive and send the image data sent by the data storage module;

when the processor sends static image data, the static image data received by the data receiver being processed by the image processing module, the pulse width modulation register storing a backlight adjustment signal generated by the image processing module processing the static image data, the static image data processed by the image processing module being stored in the data storage module, the time sequence controller controlling the static image data stored in the data storage module to send to the source electrode driver, simultaneously outputting the backlight adjustment signal stored in the pulse width modulation register.

2. The display driver according to claim 1, wherein when the display processor sends dynamic image data, the dynamic image data received by the data receiver is stored in the data storage module after being processed by the image processing module, the pulse width modulation register stores a dynamic backlight adjustment signal generated by the image processing module processing each of the dynamic image data, the time sequence controller reads the dynamic image data stored in the data storage module and sends to the source electrode driver, simultaneously the time sequence controller reads the dynamic backlight adjustment signal stored in the pulse width modulation register to adjust backlight.

3. The display driver according to claim 2, wherein the image processing module comprises a color enhancement module and a dynamic backlight adjustment module, the color enhancement module enhances colors of the image data sent by the data receiver, the dynamic backlight adjustment module adjusts a gray scale of the image data processed by the color enhancement module and generates a corresponding backlight adjustment signal.

4. The display driver according to claim 1, wherein the image processing module comprises a color enhancement module and a dynamic backlight adjustment module, the color enhancement module enhances colors of the image data sent by the data receiver, the dynamic backlight adjustment module adjusts a gray scale of the image data processed by the color enhancement module and generates a corresponding backlight adjustment signal.

5. A display, the display comprising a display panel and a display driver; the display driver and the display panel are connected electrically to drive a circuit of the display panel;

the driver comprising a data receiver, an image processing module, a data storage module, a time sequence controller and a source electrode driver;

the data receiver receiving the image data sent from the processor and sending to the image processing module, the image processing module processing the image data sent by the data receiver, wherein the display driver further comprises a pulse width modulation register;

the data storage module storing the image data processed by the image processing module;

the pulse width modulation register storing a backlight adjustment signal generated after the image processing module processing static image data;

the time sequence controller controlling the source electrode driver to receive and send the image data sent by the data storage module;

when the processor sends static image data, the static image data received by the data receiver being processed by the image processing module, the pulse width modulation register storing a backlight adjustment signal generated by the image processing module processing the static image data, the static image data processed by the image processing module being stored in the data storage module, the time sequence controller controlling the static image data stored in the data storage module to send to the source electrode driver, simultaneously outputting the backlight adjustment signal stored in the pulse width modulation register.

6. The display according to claim 5, wherein when the display processor sends dynamic image data, the dynamic image data received by the data receiver is stored in the data storage module after being processed by the image processing module, the pulse width modulation register stores a dynamic backlight adjustment signal generated by the image processing module processing each of the dynamic image data, the time sequence controller reads the dynamic image data stored in the data storage module and sends to the source electrode driver, simultaneously the time sequence controller reads the dynamic backlight adjustment signal stored in the pulse width modulation register to adjust backlight.

7. The display according to claim 6, wherein the image processing module comprises a color enhancement module and a dynamic backlight adjustment module, the color enhancement module enhances colors of the image data sent by the data receiver, the dynamic backlight adjustment module adjusts a backlight gray scale and brightness of the image data processed by the color enhancement module.

8. The display according to claim 5, wherein the image processing module comprises a color enhancement module and a dynamic backlight adjustment module, the color enhancement module enhances colors of the image data sent by the data receiver, the dynamic backlight adjustment module adjusts a backlight gray scale and brightness of the image data processed by the color enhancement module.

9. The display according to claim 5, wherein the display is a liquid crystal display.

10. The display according to claim 5, wherein the display further comprises a thin film transistor switch device, the source electrode driver is applied to connect a source electrode of the thin film transistor switch device.

11. A mobile terminal, wherein the mobile terminal comprises a display and a mainboard, the mainboard has a processor, the processor is connected to the display driver, the display comprises a display panel and a display driver; the display driver and the display panel are connected electrically to drive a circuit of the display panel;

the driver comprising a data receiver, an image processing module, a data storage module, a time sequence controller and a source electrode driver;

the data receiver receiving the image data sent from the processor and sending to the image processing module, the image processing module processing the image data sent by the data receiver, wherein the display driver further comprises a pulse width modulation register;

the data storage module storing the image data processed by the image processing module;

the pulse width modulation register storing a backlight adjustment signal generated after the image processing module processing static image data;

the time sequence controller controlling the source electrode driver to receive and send the image data sent by the data storage module;

when the processor sends static image data, the static image data received by the data receiver being processed by the image processing module, the pulse width modulation register storing a backlight adjustment signal generated by the image processing module processing the static image data, the static image data processed by the image processing module being stored in the data storage module, the time sequence controller controlling the static image data stored in the data storage module to send to the source electrode driver, simultaneously outputting the backlight adjustment signal stored in the pulse width modulation register.

12. The mobile terminal according to claim 11, wherein when the display processor sends dynamic image data, the dynamic image data received by the data receiver is stored in the data storage module after being processed by the image processing module, the pulse width modulation register stores a dynamic backlight adjustment signal generated by the image processing module processing each of the dynamic image data, the time sequence controller reads the dynamic image data stored in the data storage module and sends to the source electrode driver, simultaneously the time sequence controller reads the dynamic backlight adjustment signal stored in the pulse width modulation register to adjust backlight.

13. The mobile terminal according to claim 12, wherein the image processing module comprises a color enhancement module and a dynamic backlight adjustment module, the color enhancement module enhances colors of the image data sent by the data receiver, the dynamic backlight adjustment module adjusts a backlight gray scale and brightness of the image data processed by the color enhancement module.

14. The mobile terminal according to claim 11, wherein the image processing module comprises a color enhancement module and a dynamic backlight adjustment module, the color enhancement module enhances colors of the image data sent by the data receiver, the dynamic backlight adjustment module adjusts a backlight gray scale and brightness of the image data processed by the color enhancement module.

15. The mobile terminal according to claim 11, wherein the display is a liquid crystal display.

16. The mobile terminal according to claim 11, wherein the display further comprises a thin film transistor switch device, the source electrode driver is applied to connect a source electrode of the thin film transistor switch device.

* * * * *